US006684959B1

(12) United States Patent
Juidici et al.

(10) Patent No.: US 6,684,959 B1
(45) Date of Patent: Feb. 3, 2004

(54) FOAM CONCENTRATE PROPORTIONING SYSTEM AND METHODS FOR RESCUE AND FIRE FIGHTING VEHICLES

(75) Inventors: Robert P. Juidici, New London, WI (US); Clarence A. Grady, Larsen, WI (US); Andrew P. Klein, Appleton, WI (US); Brian D. Piller, Neenah, WI (US); Michael R. Moore, Larsen, WI (US)

(73) Assignee: Pierce Manufacturing Inc., Appleton, WI (US)

( * ) Notice: Subject to any disclaimer, the term of this patent is extended or adjusted under 35 U.S.C. 154(b) by 43 days.

(21) Appl. No.: 10/211,981

(22) Filed: Aug. 2, 2002

(51) Int. Cl.[7] ..... A62C 2/00

(52) U.S. Cl. ..... 169/44; 169/13; 169/14; 169/24; 239/68; 239/73; 239/304

(58) Field of Search ..... 169/13, 14, 15, 169/24, 44; 239/68, 73, 69, 303, 304, 305

(56) References Cited

U.S. PATENT DOCUMENTS

| | | | | |
|---|---|---|---|---|
| 3,677,092 A | | 7/1972 | Guarino | |
| 3,786,869 A | * | 1/1974 | McLoughlin | 169/24 |
| 3,883,075 A | * | 5/1975 | Edney | 239/380 |
| 3,945,252 A | * | 3/1976 | Fiore | 73/204.19 |
| 4,037,664 A | | 7/1977 | Gibson | |
| 4,064,891 A | | 12/1977 | Eberhardt | |
| 4,189,005 A | | 2/1980 | McLoughlin | |
| 4,259,038 A | | 3/1981 | Jorgensen et al. | |
| 4,324,294 A | | 4/1982 | McLoughlin et al. | |
| 4,417,601 A | | 11/1983 | Bennett | |
| 4,436,487 A | | 3/1984 | Purvis et al. | |
| 4,448,256 A | | 5/1984 | Eberhardt et al. | |
| 4,474,680 A | | 10/1984 | Kroll | |
| 4,526,234 A | | 7/1985 | Little | |
| 4,554,939 A | | 11/1985 | Kern et al. | |
| 4,633,895 A | | 1/1987 | Eberhardt | |
| 4,830,589 A | | 5/1989 | Pareja | |
| 4,899,825 A | | 2/1990 | Bosoni et al. | |
| 5,009,244 A | | 4/1991 | Grindley et al. | |
| 5,174,383 A | | 12/1992 | Haugen et al. | |
| 5,218,988 A | | 6/1993 | McNamara et al. | |
| 5,232,052 A | | 8/1993 | Arvidson et al. | |
| 5,271,526 A | * | 12/1993 | Williams | 222/16 |
| 5,284,174 A | | 2/1994 | Norman | |
| 5,291,951 A | | 3/1994 | Morand | |
| 5,313,548 A | | 5/1994 | Arvidson et al. | |
| 5,335,734 A | * | 8/1994 | Scott et al. | 169/15 |
| 5,411,100 A | | 5/1995 | Laskaris et al. | |
| 5,427,181 A | | 6/1995 | Laskaris et al. | |
| 5,494,112 A | | 2/1996 | Arvidson et al. | |
| RE35,362 E | | 10/1996 | Arvidson et al. | |
| 5,680,329 A | | 10/1997 | Lloyd et al. | |
| 5,727,933 A | | 3/1998 | Laskaris et al. | |
| 5,764,463 A | | 6/1998 | Arvidson et al. | |
| 5,765,644 A | | 6/1998 | Arvidson et al. | |

(List continued on next page.)

FOREIGN PATENT DOCUMENTS

| | | | |
|---|---|---|---|
| DE | 3038-334 | | 10/1982 |
| EP | 000040595 A2 | * | 11/1981 |

*Primary Examiner*—William E. Tapolcai
*Assistant Examiner*—Mohammad M. Ali
(74) *Attorney, Agent, or Firm*—Ryan Kromholz & Manion, S.C.

(57) ABSTRACT

A system and method of maintaining a desired additive to water ration in a fire-fighting system including a water flow sensor configured to measure the water flow rate, a water pump, a hydraulic pump, a linear hydraulic cylinder driven by the hydraulic pump, an additive pump mechanically coupled to the linear hydraulic cylinder; and a pump displacement sensor configured to sense the position of the additive pump, the pump displacement sensor being in communication with the water flow sensor to maintain a pre-determined ratio of additive to water.

38 Claims, 5 Drawing Sheets

U.S. PATENT DOCUMENTS 5,803,596 A 9/1998 Stephens
5,816,328 A 10/1998 Mason et al.
5,881,818 A * 3/1999 Lee et al. ..... 169/15
5,909,775 A 6/1999 Grindley
5,960,887 A * 10/1999 Crabtree ..... 169/15
5,979,564 A * 11/1999 Crabtree ..... 169/15
6,009,953 A 1/2000 Laskaris et al.
6,164,381 A 12/2000 Sundholm
6,276,459 B1 * 8/2001 Herrick et al. ..... 169/14
6,454,540 B1 9/2002 Terefinko et al.
6,547,528 B1 * 4/2003 Yoshida ..... 417/34

* cited by examiner

FOAM CONCENTRATE PROPORTIONING SYSTEM AND METHODS FOR RESCUE AND FIRE FIGHTING VEHICLES

FIELD OF THE INVENTION

This invention relates to systems for extinguishing fires, and in particular to a system for adding liquid foam concentrate into water lines in predetermined proportions.

BACKGROUND OF THE INVENTION

Conventional foam additive systems for fighting fires employ numerous mechanisms for supplying foam liquid concentrate via supply conduits to one or more of the discharge outlets of a water pump. The goal of such a system is to achieve "balanced flow" between the fluid line, typically a water line; and the additive line, typically a foam concentrate supply line. At balanced flow, the system responds to high fluid flow with a correlatively high additive flow, and corresponds to low fluid flow with a relatively low additive flow. Thus, at high water flow, foam is added at an equal flow calculated to maintain a predetermined ratio of water to foam. The same is true for low flow.

"Balanced flow" is particularly important in the firefighting field, because the water to foam ratio is critical to optimize fire fighting efficiency based on the type of fire fuel that that is present. Ranges between 0.2%–6% of foam have been reported as optimal, depending on the composition and fuel of the target fire. Further complicating the task of balancing flow is the extremely variable water flows and pressures. Thus, the volume and pressure of foam must meet the varying pressure and volume of water being used.

An exemplary embodiment of an additive pump system is a hydraulically powered demand system that varies additive pump output in response to different readings from a flow meter installed in the water pump discharge line that measures water flow rate. In a "flow rate" system, balanced pressure is achieved by control of water flow and additive flow rates.

One such flow rate system is disclosed in U.S. Pat. No. 5,174,383 (1992) to Haugen et al. The water flow meter signal is processed by a controller, e.g., microprocessor. The microprocessor sends a signal to the additive pump, e.g., a positive displacement piston pump, to regulate the flow rate of the additive line. Further, a measure of the additive pump output is fed back to the microprocessor, e.g., a speed signal is sent from a tachometer coupled to the drive shaft of the additive pump, to maintain the additive flow rate at the proper proportion to the water flow rate.

Another flow rate system is disclosed in U.S. Pat. No. 5,765,644 (1998) to Arvidson. To maintain the additive flow rate at the proper proportion to the water flow rate, the additive pump provides a feedback signal from a magnetic pickup associated with a notched wheel coupled to the drive shaft of the additive pump. Alternatively, a flow meter may be employed to measure the additive flow rate downstream of the additive pump.

While prior art systems are capable of accurately maintaining a pre-selected ratio of additive to water, these systems typically employ expensive pumps, e.g., gear pumps. Further, these are complicated systems, with the complex nature of the system negatively impacting the system reliability and cost.

The need remains for simple, accurate, and cost-effective control and monitoring of additive line flow. To overcome shortcomings of the prior art, an improved system to accurately maintain a pre-selected ratio of additive to water is disclosed. The system employs a novel pump and hydraulic cylinder arrangement, including a linear variable displacement transducer (LVDT) to measure the position, and thereby determine the speed, of the additive pump. The system provides an accurate, yet simple, cost-effective proportioning system for maintaining a desired foam to water ratio.

SUMMARY OF THE INVENTION

One aspect of the invention provides an additive proportioning system for a firefighting vehicle. The system comprises a source of pressurized water, a source of additive, and a hydraulic pump. A water flow sensor is provided that is responsive to the source of pressurized water and configured to measure a water flow rate.

An actuator is fluidly connected to and driven by the hydraulic pump. An additive pump is mechanically coupled to the actuator and fluidly connected to the source of additive. The system further provides a pump displacement sensor configured to sense the position of the additive pump. The pump displacement sensor is in communication with the water flow sensor to maintain a pre-determined ration of additive to water.

In a preferred embodiment, the pump displacement sensor is a linear variable displacement transducer, the additive pump is a double acting piston pump, and the actuator is a hydraulic cylinder.

According to another aspect of the invention, the system further comprises a programmable logic controller.

According to another aspect of the invention, the system further comprises a proportioning valve in communication with a programmable logic computer.

According to another aspect of the invention, the additive is a thixotropic substance.

According to yet another aspect of the invention, the system provides multiple sources of additive.

According to another aspect of the invention, the system further comprises a means for mixing the additive with the water.

Another aspect of the invention provides an apparatus for mixing water and an additive in a firefighting vehicle. The apparatus comprises a programmable logic computer, a water flow sensor, and a hydraulic pump. The water flow sensor is responsive to a source of pressurized water and is electronically coupled to the controller. An actuator is fluidly connected to and driven by the hydraulic pump. An additive pump is mechanically coupled to the actuator and fluidly connected to a source of additive. An additive pump displacement sensor is configured to sense the position of the additive pump and is in communication with the controller.

In a preferred embodiment, the actuator is a hydraulic cylinder, the pump displacement sensor is a linear variable displacement transducer, and the additive pump is a double acting piston pump.

In a preferred embodiment, the controller provides communication between the water flow sensor, the proportioning valve, and the additive pump to maintain a pre-determined ratio of additive to water.

According to another aspect of the invention, the apparatus further comprises a proportioning valve fluidly connected to the hydraulic pump and the actuator. In a preferred embodiment, the proportioning valve is in communication with the controller.

According to another aspect of the invention, the apparatus further comprises a means for mixing the additive with the water.

According to another aspect of the invention, the controller adjusts the additive pump speed in response to the sensed direction of the additive pump.

Another aspect of the invention provides an additive proportioning apparatus comprising an actuator and an additive pump coupled to and driven by the actuator. The actuator is coupled to a linear variable displacement transducer that senses the position of the additive pump.

Another aspect of the invention provides a method of maintaining a desired additive to water ratio in a fire-fighting system. The method comprises the steps of inputting a pre-determined additive to water ratio into the controller; sensing the water flow rate; computing the additive flow rate by determining the position of a positive displacement piston pump at at least two defined intervals; computing the actual additive to water ratio based on the sensed water flow and additive flow rates; comparing the computed ratio with the input ratio; and adjusting the output of the positive displacement pump to substantially match the input ratio.

According to another aspect of the invention, the method further comprises the steps of re-sensing the water flow rate; re-sensing the additive flow rate; re-computing the actual additive to water ratio; re-comparing the computed ratio with the input ratio; and re-adjusting the output of the positive displacement pump.

DETAILED DESCRIPTION

Although the disclosure hereof is detailed and exact to enable those skilled in the art to practice the invention, the physical embodiments herein disclosed merely exemplify the invention that may be embodied in other specific structure. While the preferred embodiment has been described, the details may be changed without departing from the invention, which is defined by the claims.

I. Additive Proportioning System

Figure 1:
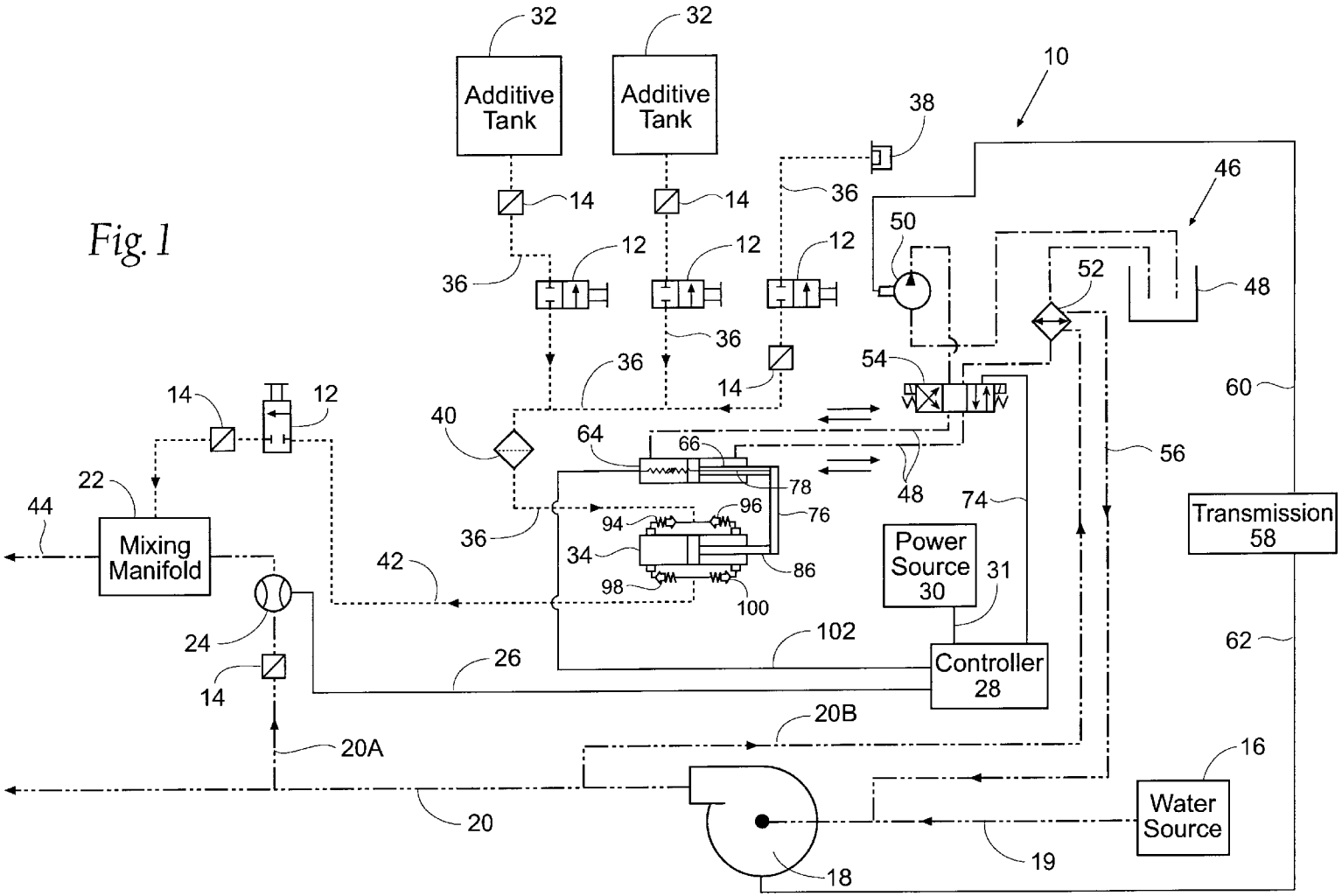
FIG. 1 is a schematic of a foam concentrate proportioning system for rescue and fire fighting vehicles embodying features of the invention.

An additive proportioning system 10 suitable for use in fire-fighting and rescue vehicles is shown schematically in FIG. 1. The system 10 desirably includes a series of conventional ball valves 12 and check valves 14 to control the flow of fluid through the system 10. If desired, ball valves 12 can be motorized for ease of operation. It is to be understood that the arrangement of ball valves 12 and check valves 14 can vary. In addition, a greater or lesser number of ball valves 12 and check valves 14 than shown in the illustrated embodiment can be provided.

A primary fire fighting fluid, such as water is supplied via the water supply 16, e.g., a fire hydrant. The water supply 16 is connected to a water pump 18 through intake conduit 19 as is common in fire-fighting apparatus. Arrows and double dot dash lines in FIG. 1 depict the path of water flow. As FIG. 1 shows, the water flow path is split as the water is discharged from the water pump 18 through branched conduit 20. A portion of the water is directly discharged through conduit 20. Thus, conduit 20 can serve as a waste line. Alternatively, conduit 20 can be used as an additional fire-fighting line should it be desirable to discharge water directly onto a fire without the addition of an additive.

A portion of the water discharged from the water pump 18 follows the path of branch 20A into a mixing manifold 22 for mixing with an additive. A conventional flow meter 24 comprised of an electro-mechanical sensor monitors the water flow rate through conduit 20A. In the preferred embodiment, the flow meter 24 is a Model 220B flow meter manufactured by Data Industrial of Mattapoisett, Mass. The sensed data is then input through signal line 26 to a programmable controller 28, e.g., a conventional microprocessor, to calculate the water flow rate.

In the preferred embodiment, the controller 28 is a programmable digital controller, e.g., Pierce brand manufactured by HED of Hardford, Wis. A power source 30, such as the power source from the rescue or firefighting vehicle, provides power to the controller 28 through electrical line 31. A switch or switching means is also provided to turn the controller 28 "on" and "off" at the appropriate times (not shown).

In the preferred embodiment, a thixotropic material is the additive traditionally mixed with water and used to fight fires. More preferably, liquid foam concentrate is the additive to the water. However, additives other than a thixotropic material or liquid foam concentrate may be used based on fire fighting efficacy.

Liquid foam concentrate is supplied from dual additive tanks 32, which may hold the same or different additives. The path of additive flow is depicted by arrows and dashed lines in FIG. 1. Additive tanks 32 are connected to an additive pump 34, which will be described in detail later. Branched conduit 36 connects the additive tanks 32 to the additive pump 34. An inlet 38 can be provided to allow for the connection of an external additive source with conduit 36. Conduit 36 can include a screen filter 40 that serves to remove undesired matter and debris from the additive solution.

As will be apparent, any number of additive tanks 32 or external additive sources can be employed. Conduit 42 connects the additive pump 34 with the mixing manifold 22 for mixing the additive with water and discharging the mixture through conduit 44, e.g., via a hose and nozzle (not shown).

The system 10 includes a conventional hydraulic system 46 of the type well known in the art. Arrows and dot-dash lines in FIG. 1 depict the flow path of hydraulic fluid through the hydraulic system 46. The system 46 comprises a hydraulic fluid reservoir 48, a hydraulic pump 50, a heat exchanger 52 and a proportional directional control valve 54. In the preferred embodiment, the pump 50 is a gear pump manufactured by Bosch Rexroth of Hoffman Estates, IL. The control valve 54 is a proportional control valve. In the preferred embodiment, the valve 54 is a Rexroth valve manufactured by Bosch Rexroth of Hoffman Estates, Ill. A portion of the water as it is discharged from the water pump 18 is diverted through branch 20B and is circulated through a heat exchanger 52 to cool the hydraulic circuit. A return line 56 directs the water from the heat exchanger 52 back to the water pump 18 for recycling through the system 10.

The hydraulic pump 50 may be driven by any of a number of power inputs. In the preferred embodiment, the pump 50 is driven by a water pump transmission 58 by drive shaft 60. The same transmission also drives the water pump 18 by drive shaft 62. In an alternative embodiment, the pump 18 may be driven by any conventional power take-off (not shown) on the vehicle to which the system 10 is installed. The pump 50 operates above a predetermined speed therefore assuring that a sufficient volume and pressure of hydraulic fluid is supplied to the proportional directional control valve 54.

Figure 4:
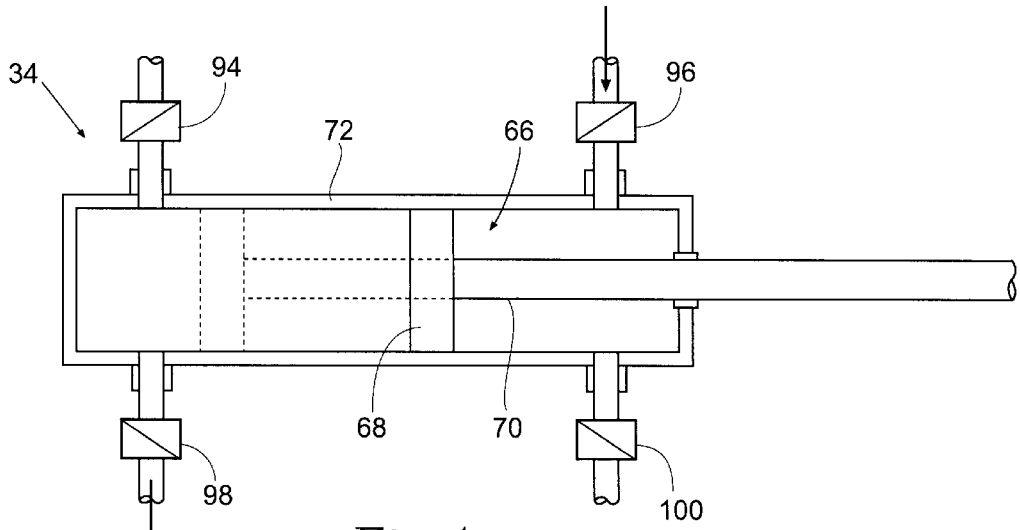
FIG. 4 is an enlarged view of the additive pump shown in FIG. 1 and showing the path of additive through the pump and the resulting movement of the piston in a forward direction.
Figure 5:
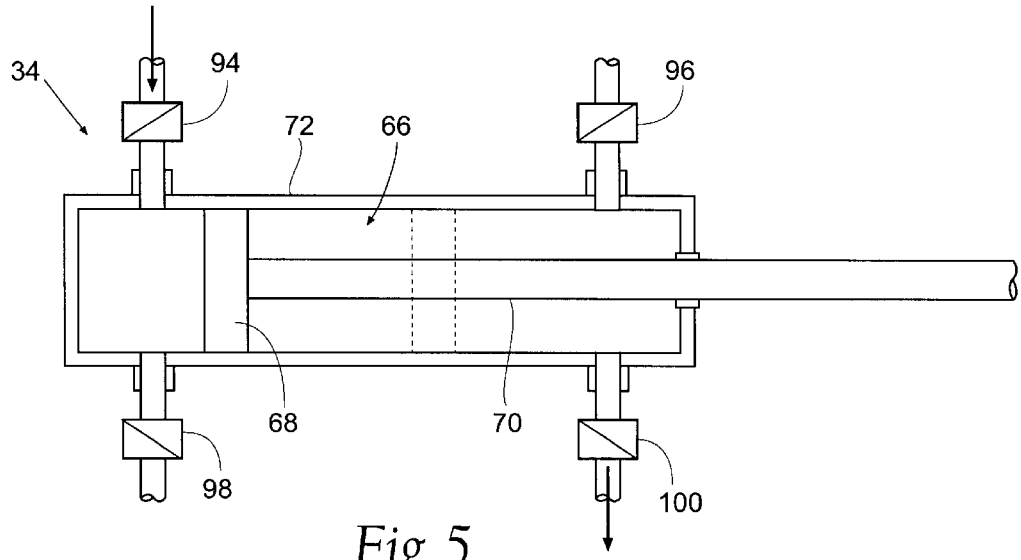
FIG. 5 is an enlarged view of the additive pump shown in FIG. 1 and showing the path of additive through the pump and the resulting movement of the piston in a reverse direction.

The hydraulic pump 50 drives a linear actuator, e.g., a conventional positive displacement, piston type hydraulic cylinder 64 having a piston/rod assembly 66The assembly 66 includes a piston 65 coupled to a rod 67 and configured for fore and aft movement within a cylinder 69 (see also FIGS. 4 and 5). In the preferred embodiment, the cylinder 64 has a piston diameter of 1.5 inches and a piston stroke of approximately eight inches.

The system 10 desirably includes a proportioning valve 54 of the type known in the art to control the direction of hydraulic fluid flow through the hydraulic cylinder 64. The proportioning valve 54 permits fluid flow in a first direction while preventing flow in the reverse direction to advance the assembly 66 of hydraulic cylinder 64 in a first direction while preventing flow in the reverse direction to advance the assembly 66 in a first direction. The valve 54 then permits flow in the reverse direction while preventing flow in the first direction thereby moving the assembly 66 in the reverse direction. The volume flow rate of hydraulic fluid is varied by the proportioning valve 54 based upon pulse width modulation input from the controller 28 through signal line 74.

Figure 2:
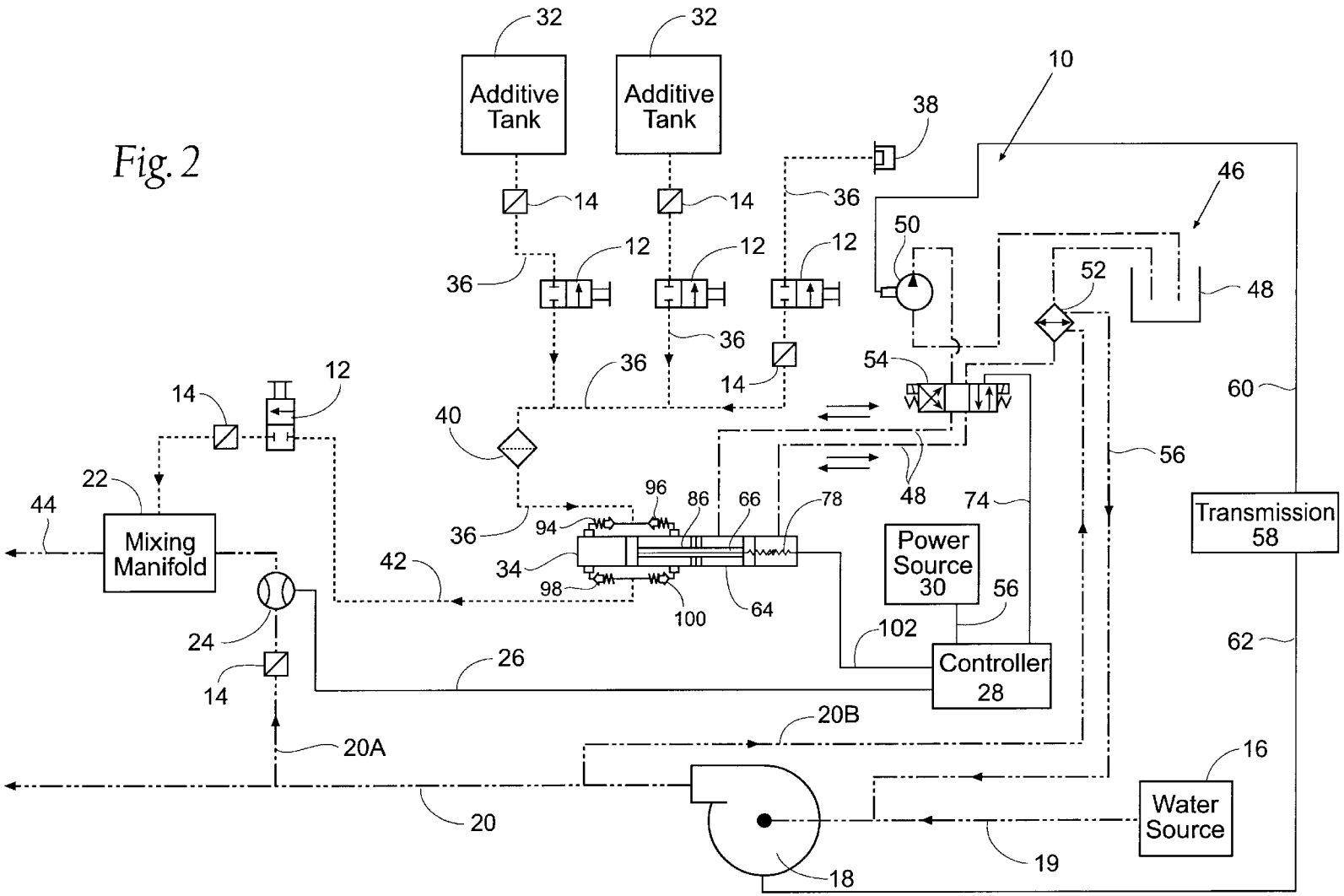
FIG. 2 is a schematic of an alternative embodiment of the system shown in FIG. 1 illustrating an alternative arrangement of the hydraulic cylinder and additive pump shown in FIG. 1.

The hydraulic cylinder 64 is mechanically coupled to (e.g., by rod 76) and serves to drive the additive pump 34. In the embodiment illustrated in FIG. 1, the hydraulic cylinder 64 is positioned spaced from and parallel to the additive pump 34. In an alternative embodiment, shown in FIG. 2, the hydraulic cylinder 64 is coupled to the additive pump 34 in a linear configuration. It is to be understood that the cylinder 64 and pump 34 may be variously positioned with respect to one another and such other arrangements will be apparent to those skilled in the art.

Figure 3:
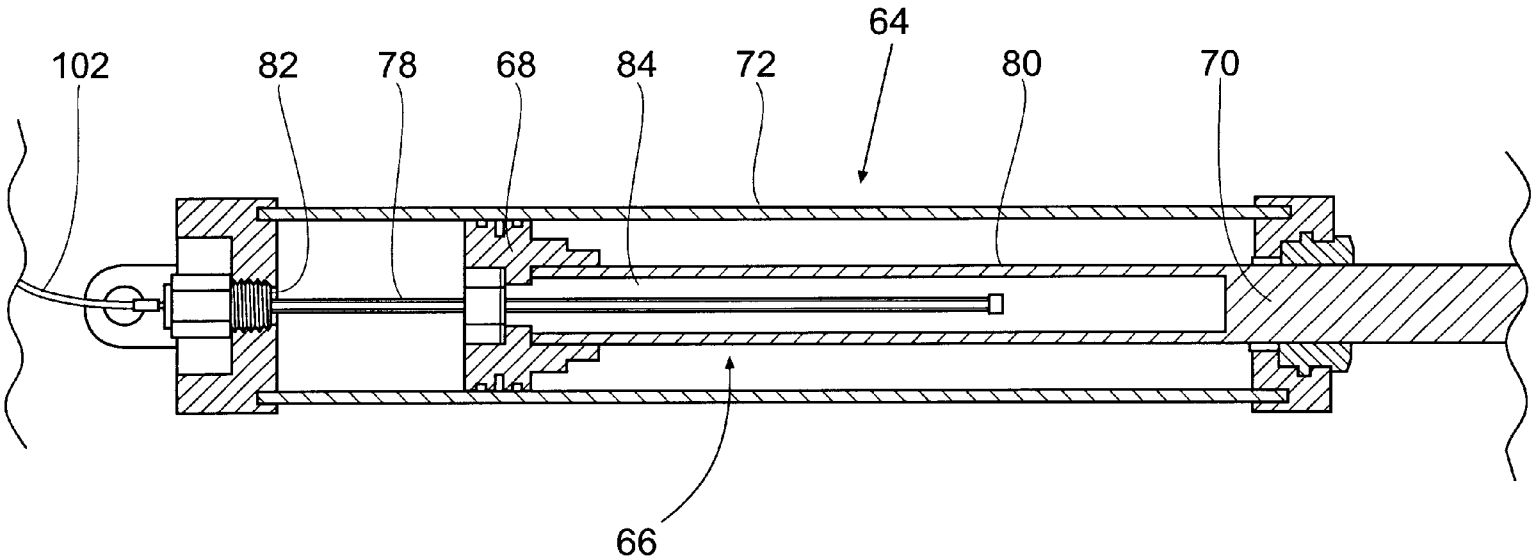
FIG. 3 is a partial sectional view of a hydraulic cylinder coupled to a linear variable displacement transducer.

With reference to FIG. 3, the hydraulic cylinder 64 carries a linear variable displacement transducer (LVDT) 78 of the type known in the art. In a preferred embodiment, the LVDT 78 is a Model ICS 100 manufactured by Penny & Giles of Cwmfelinfach, Gwent, UK and Christchurch, Dorset, UK.

The LVDT 78 can be positioned within a bore 80 in rod 70. The LVDT 78 is coupled to the cylinder 72 by threaded connector 82. The LVDT 78 includes a slider 84 which permits the LVDT 78 to remain stationary with respect to rod 70, while permitting fore and aft movement of rod 70 along the LVDT 78. Movement of rod 70 alters the voltage output of the LVDT 78. This arrangement thus permits the LVDT 78 to sense the position of the assembly 66, and thereby the position of coupled additive pump 34.

With reference to FIGS. 4 and 5, the additive pump 34 is a large bore conventional positive displacement, piston pump comprising a piston/rod assembly 86 sized and configured for fore and aft movement within a cylinder 88. The assembly 86 includes a piston 90 coupled to a rod 92 In a preferred embodiment, the pump 34 is a FSC pump manufactured by Fluid System Components of DePere, Wis. Movement of the assembly 86 in a given direction draws a pre-determined amount additive into the pump 34 and contemporaneously expels a pre-determined amount of additive from the pump 34. A pair of check valves 94 and 96 control flow of additive into the pump 34 from conduit 36. Another pair of check valves 98 and 100 control flow of additive from the pump 34 through conduit 42. This arrangement permits the pump 34 to serve as a double-acting pump, as illustrated in FIGS. 4 and 5.

As shown in FIG. 4 when the assembly86 advances in a forward direction (i.e., moves from right to left in direction of piston 90, as shown in FIG. 3), check valve 96 permits fluid flow into the pump 34 (as represented by arrow) and check valve 98 permits fluid flow out of the pump 34 (as represented by the arrow) while the remaining check valves 94 and 100 prevent flow in the reverse direction.

In this arrangement the pump displaces a given amount of fluid (F1) in front of the piston 90 (i.e., side of piston 90 away from rod 92)

As shown in FIG. 5 when the assembly 86 moves in the reverse direction (i.e., moves from left to right in direction of rod 92, as shown in FIG. 4), check valve 94 permits fluid flow into the pump 34 (as represented by the arrow) and check valve 100 permits fluid flow out of the pump (as represented by the arrow) while the remaining check valves 96 and 98 prevent flow in the reverse direction.

In this arrangement the pump 34 displaces a given amount of fluid (F2) behind the piston 90 (i.e., side of piston 90 coupled to rod 92). As is apparent to one of skill in the art, because the rod 92 consumes space that would otherwise be available for fluid, the volume of fluid displaced is reduced, i.e., F2 is less than F1.

In a representative embodiment, F1 is 0.109 gallons of additive and F2 is 0.082 gallons of additive, providing a F1/F2 ratio of 1.33/1.

The LVDT 78 senses the position of the assembly 86 at given time intervals and inputs the sensed information into the controller 28 through signal line 102 for calculation of the position and speed of the assembly 86. An input from the LVDT 78 of increased voltage corresponds to movement of the assembly 86 in the forward direction (i.e., in direction of piston 90). An input from the LVDT 78 of reduced voltage corresponds to movement of the assembly 86 in the reverse direction (i.e., in direction of rod 92). The controller 28 responds to the reduced volume of fluid displacement in the reverse direction by increasing the speed of movement of the assembly 86.

Thus, the controller 28 provides communication between the LVDT 78, the flow meter 24, and the proportioning valve 54. The rate of hydraulic fluid flow from the proportioning valve 54 is varied in response to output from the controller 28 (in response to signals received from the flow meter 24 and the LVDT 78) to control the speed of the additive pump 34 so as to maintain a pre-determined ratio of additive to water.

II. System Use

The described system 10 thus maintains the predetermined ratio by monitoring water and additive flow rates at regular intervals and adjusting the speed of the additive pump 34 in response to sensed water flow rate and the speed, direction and position of piston 90.

Figure 6:
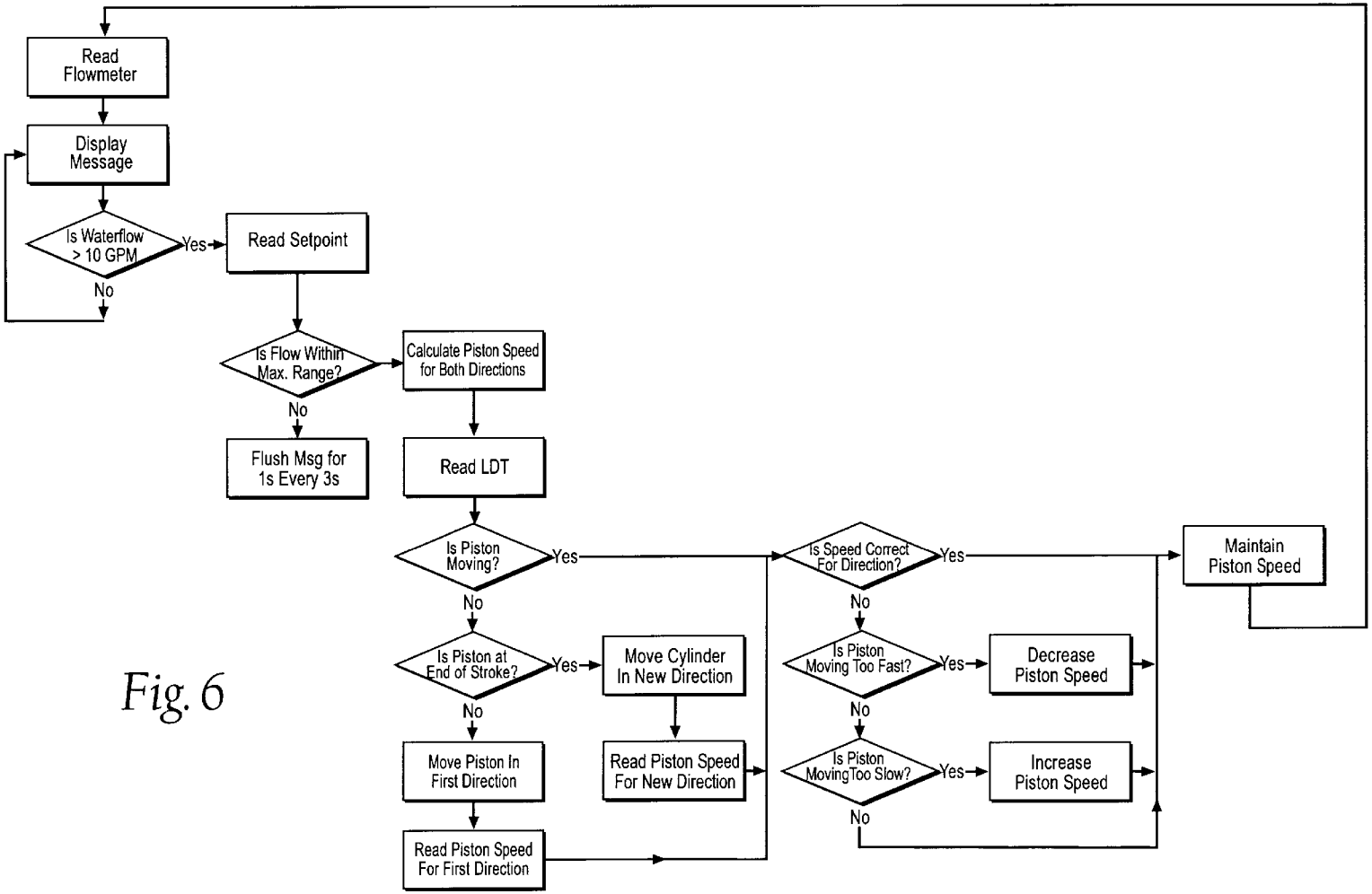
FIG. 6 is a software flow diagram useful in understanding the manner in which the microprocessor-based controller may be programmed.
Figure 1:
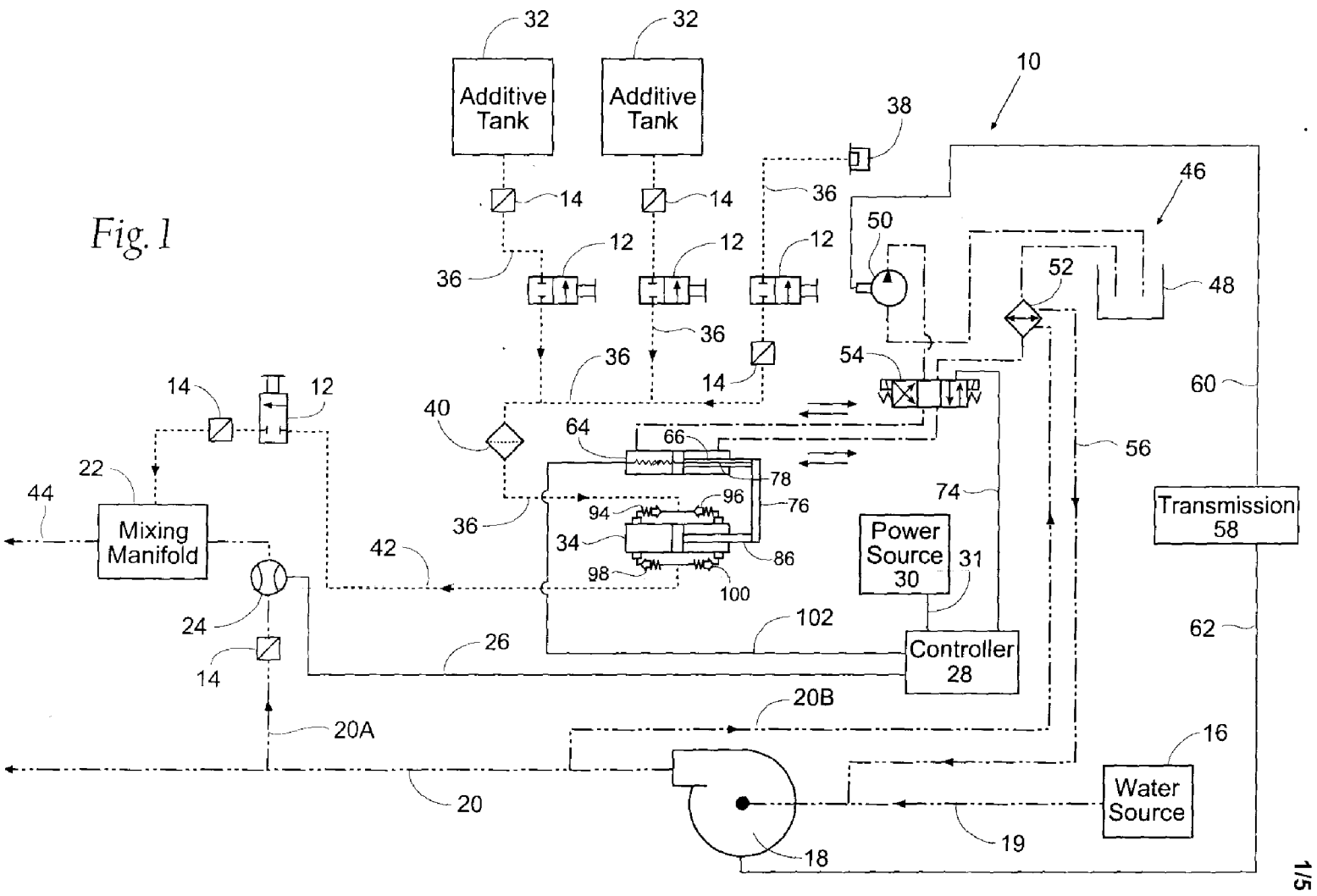
Figure 2:
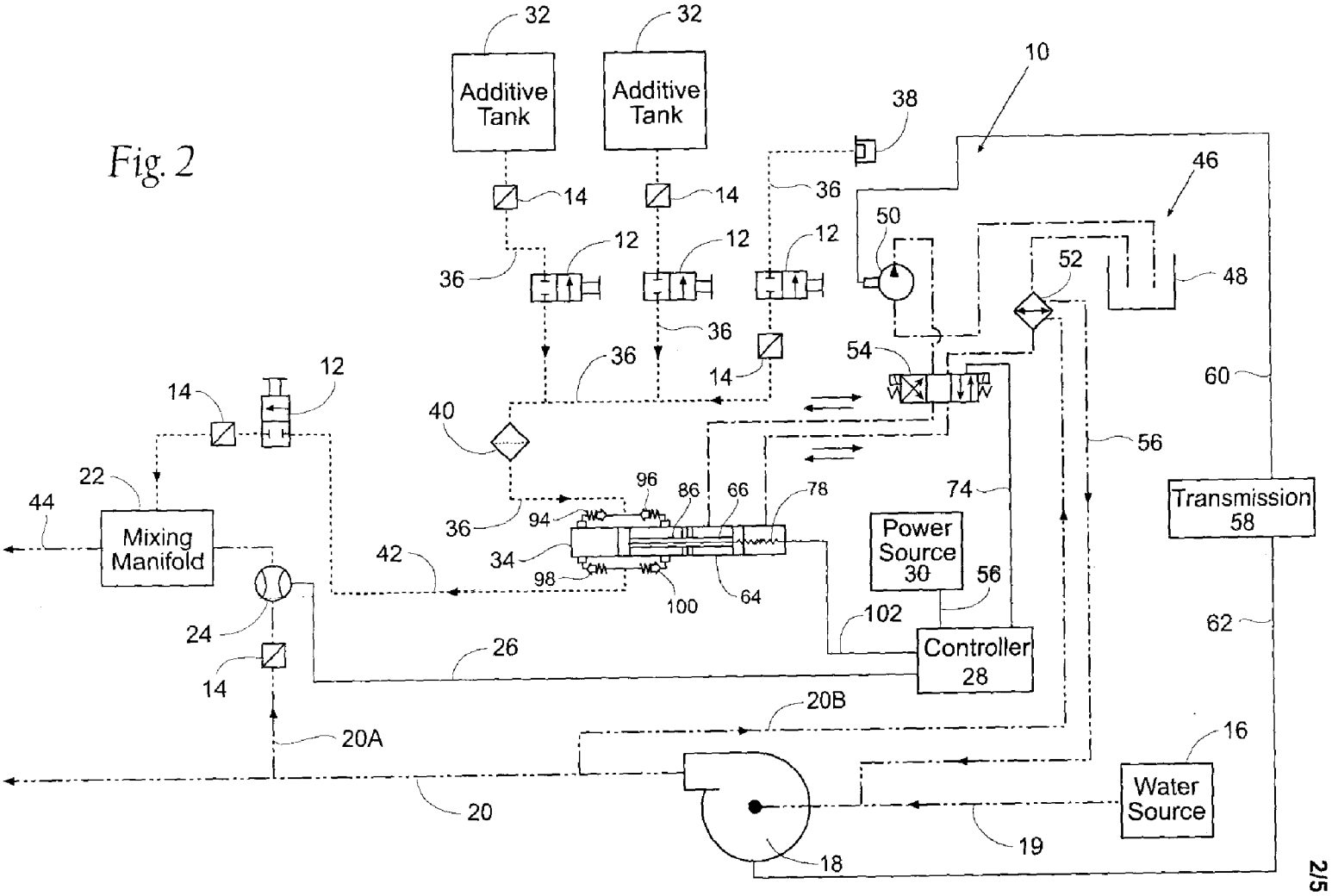
Figure 4:
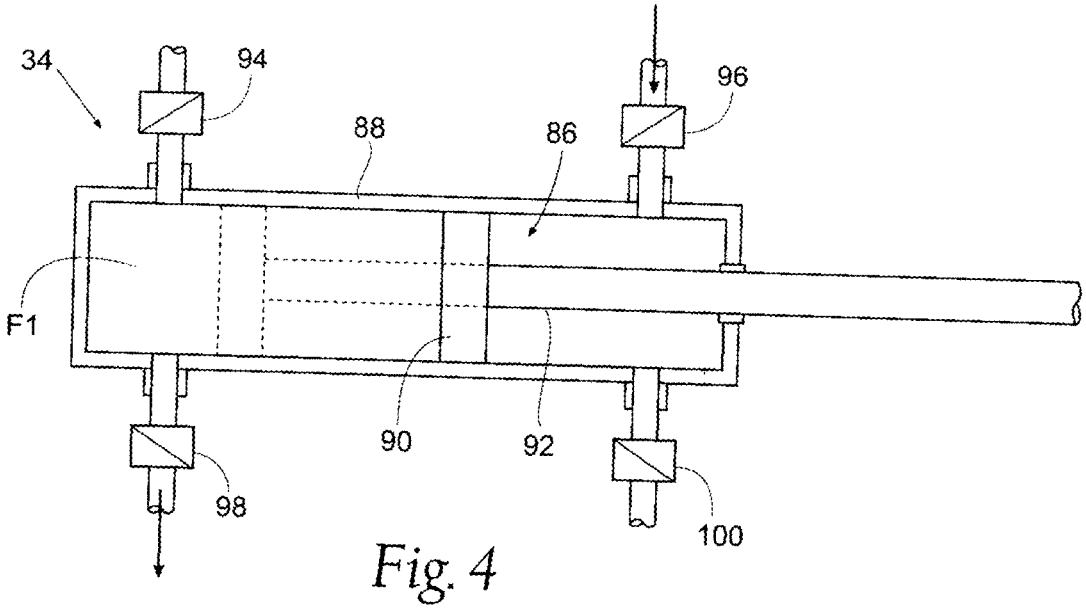
Figure 5:
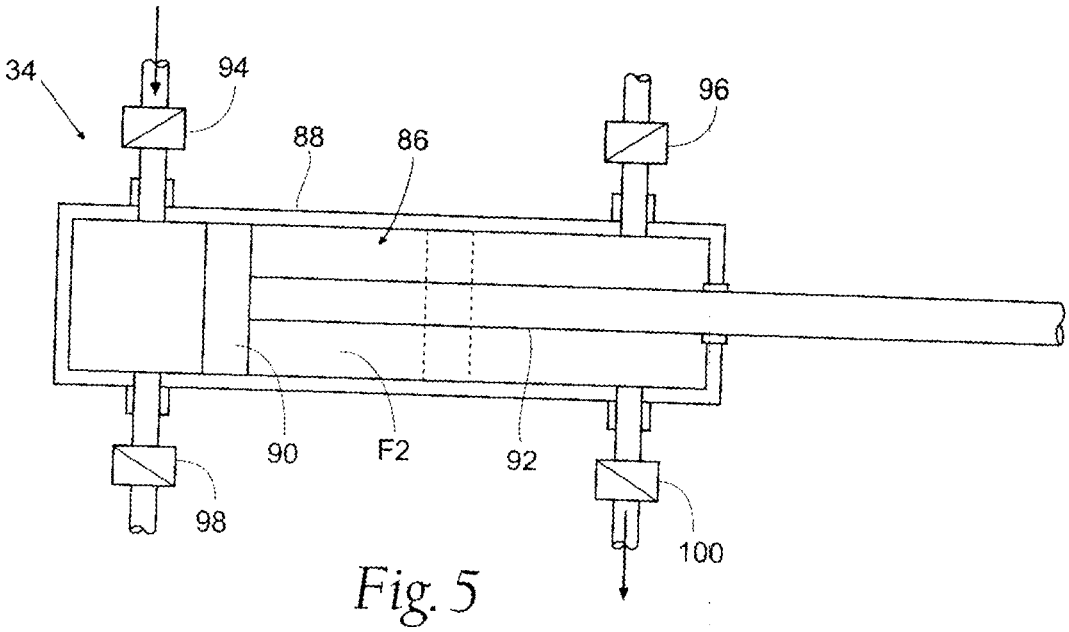

FIG. 6 provides a flow chart illustrating a portion of a program for maintaining a desired additive to water ratio. Other programs will be apparent to those skilled in the art.

The controller 28 receives input from the water flow meter 24 and compares the sensed flow to a desired flow rate (e.g., >10 GPM). A user interface desirably provides a display of the sensed flow rate and indicates whether the flow rate is within the desired range.

The controller 28 reads the desired setpoint, i.e., the desired additive to water ratio range entered previously into the controller 28 by firefighting personnel and determines whether the water flow rate is within the maximum of a pre-selected range for the desired setpoint. If the sensed flow rate is within the range, the controller 28 calculates the additive pump assembly 86 speed in both directions needed to maintain the desired setpoint. If the sensed flow rate is not within the pre-selected water flow range, the interface can be configured to display a pre-selected message at given intervals (e.g., flash message for 1 second every 3 seconds).

The controller 28 desirably reads the LVDT 78 at predefined time intervals to determine the position of the assembly 86 and thereby determines the rate of speed and the direction of the assembly 86

The controller 28 first determines if the assembly 86 is moving. In a preferred embodiment, if the controller 28 does not detect movement, the controller 28 determines whether the assembly 86 is at the end of a stroke. If the assembly 86 is not at the end of a stroke, such as in the initial start-up of the system 10, the assembly 86 is advanced in a first direction (e.g., away from rod 92 ) and the assembly 86 speed in that direction is read for input into the controller 28. If the assembly 86 is at the end of a stroke, the assembly 86 is moved in the new direction and the controller 28 then reads the assembly 86 speed for the new direction.

When the controller 28 detects movement of the assembly 86 , the controller 28 then determines if the assembly 86 is moving at the correct speed to maintain the desired ratio. If the assembly 86 is moving at the desired speed, the controller 28 sends an output signal to the proportioning valve 54 to maintain the desired speed. However, if the assembly 86 is moving at too fast or too slow of speed, the controller 28 sends an output signal to the proportioning valve 54 to decrease or increase assembly 86 speed respectively. The system thereby maintains the desired additive to water ratio.

An inherent drawback of double-acting pump systems is that the volume of fluid ahead of the piston 90 is greater than the volume of fluid behind the piston 90. As previously noted, the controller 28 compensates for this inherent drawback so that pump 34 output remains constant.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An additive proportioning system for a firefighting vehicle comprising:

a source of pressurized water;

a source of additive;

a water flow sensor responsive to the source of pressurized water and configured to measure a water flow rate;

a hydraulic pump;

an actuator fluidly connected to and driven by the hydraulic pump;

an additive pump mechanically coupled to the actuator and fluidly connected to the source of additive; and a pump displacement sensor configured to sense the position of the additive pump, said pump displacement sensor being in communication with the water flow sensor to maintain a pre-determined ratio of additive to water.

2. A system as in claim 1 wherein the hydraulic pump is driven by an auxiliary transmission.

3. A system as in claim 1 wherein the hydraulic pump is driven by a power take-off of the vehicle.

4. A system as in claim 1 further comprising:

a programmable logic controller.

5. A system as in claim 4 wherein the water flow sensor sends an input signal to the controller.

6. A system as in claim 4 wherein the pump displacement sensor sends an input signal to the controller.

7. A system as in claim 4 wherein the water flow sensor and the pump displacement sensor send an input signal to the controller.

8. A system as in claim 1 further comprising:

a proportioning valve fluidly coupled to a source of hydraulic fluid and configured to drive the actuator.

9. A system as in claim 8 wherein the proportioning valve is in communication with a programmable logic controller.

10. A system as in claim 9 wherein the controller sends an output signal to the proportioning valve.

11. A system as in claim 1 wherein the additive is a thixotropic substance.

12. A system as in claim 1 further comprising:

multiple sources of additive.

13. A system as in claim 1, further comprising:

a means for mixing the additive with the water.

14. A system as in claim 13 wherein the means for mixing the additive with the water is a manifold.

15. A system as in claim 1 wherein the actuator is a hydraulic cylinder.

16. A system as in claim 1 wherein the pump displacement sensor is a linear variable displacement transducer.

17. A system as in claim 1 wherein the additive pump is a piston pump.

18. A system as in claim 17 wherein the additive pump is a double-acting piston pump.

19. An apparatus for mixing water and an additive in a firefighting vehicle, the apparatus comprising:

a programmable logic controller;

a water flow sensor responsive to a source of pressurized water and electronically coupled to the controller;

a hydraulic pump;

an actuator fluidly connected to and driven by the hydraulic pump;

an additive pump mechanically coupled to the actuator and fluidly connected to a source of additive; and an additive pump displacement sensor configured to sense the position of the additive pump, the pump displacement sensor being in communication with the controller.

20. An apparatus as in claim 19 wherein the hydraulic pump is driven by a hydraulic pump motor.

21. An apparatus as in claim 19 further comprising:

a proportioning valve fluidly connected to the hydraulic pump and the actuator.

22. A system as in claim 21 wherein the proportioning valve is in communication with the controller.

23. An apparatus as in claim 22 wherein the controller provides communication between the water flow sensor, the proportioning valve, and the additive pump to maintain a pre-determined ratio of additive to water.

24. An apparatus as in claim 19, further comprising:

a means for mixing the additive with the water.

25. An apparatus as in claim 24 wherein the means for mixing the additive with the water is a manifold.

26. An apparatus as in claim 19 wherein the actuator is a hydraulic cylinder.

27. An apparatus as in claim 19 wherein the pump displacement sensor is a linear variable displacement transducer.

28. An apparatus as in claim 19 wherein the additive pump is a piston pump.

29. An apparatus as in claim 28 wherein the additive pump is a double acting piston pump.

30. An apparatus as in claim 19 wherein wherein the programmable logic controller adjusts the additive pump speed in response to the sensed direction of the additive pump.

31. An additive proportioning apparatus comprising:

an actuator;

an additive pump coupled to and driven by the actuator;

wherein the actuator is coupled to a linear variable displacement transducer that senses the position of the additive pump.

32. An apparatus as in claim 31 wherein the additive pump is a positive displacement piston pump.

33. An apparatus as in claim 32 wherein the additive pump is a double acting pump.

34. An apparatus as in claim 31 wherein the actuator is a positive displacement piston pump.

35. An apparatus as in claim 31 wherein the additive is a thixotropic substance.

36. A method of maintaining a desired additive to water ratio in a fire-fighting system comprising the steps of:

inputting into a controller a pre-determined additive to water ratio;

sensing the water flow rate;

computing the additive flow rate by determining the position of a positive displacement piston pump at at least two defined intervals;

computing the actual additive to water ratio based on the sensed water flow and additive flow rates;

comparing the computed ratio with the input ratio; and adjusting the output of the positive displacement pump to substantially match the input ratio.

37. A method as in claim 36, further comprising the steps of:

re-sensing the water flow rate;

re-sensing the additive flow rate;

re-computing the actual additive to water ratio;

re-comparing the computed ratio with the input ratio; and re-adjusting the output of the positive displacement pump.

38. A method as in claim 36 wherein the additive is a thixotropic substance.

* * * * *

UNITED STATES PATENT AND TRADEMARK OFFICE

CERTIFICATE OF CORRECTION

PATENT NO. : 6,684,959 B1 
DATED : February 3, 2004
INVENTOR(S) : Robert P. Juidici et al.

It is certified that error appears in the above-identified patent and that said Letters Patent is hereby corrected as shown below:

Title page,
Item [57], ABSTRACT,
Line 2, delete "ration" and insert -- ratio --.

Signed and Sealed this

Twenty-ninth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,684,959 B1 
DATED : February 3, 2004
INVENTOR(S) : Juidici et al.

It is certified that error appears in the above-identified patent and that said Letters Patent is hereby corrected as shown below:

Title page,
Showing the illustrative figure should be deleted to be replaced with the attached title page.

Drawing sheets consisting of Figs. 1, 2, 4, and 5, should be deleted to be replaced with the drawing sheets, consisting of Figs. 1, 2, 4, and 5, shown on the attached page.

Signed and Sealed this

Twenty-eighth Day of December, 2004

JON W. DUDAS
*Director of the United States Patent and Trademark Office*

(12) United States Patent
Juidici et al.

(10) Patent No.: US 6,684,959 B1
(45) Date of Patent: Feb. 3, 2004

(54) FOAM CONCENTRATE PROPORTIONING SYSTEM AND METHODS FOR RESCUE AND FIRE FIGHTING VEHICLES

(75) Inventors: Robert P. Juidici, New London, WI (US); Clarence A. Grady, Larsen, WI (US); Andrew P. Klein, Appleton, WI (US); Brian D. Piller, Neenah, WI (US); Michael R. Moore, Larsen, WI (US)

(73) Assignee: Pierce Manufacturing Inc., Appleton, WI (US)

( * ) Notice: Subject to any disclaimer, the term of this patent is extended or adjusted under 35 U.S.C. 154(b) by 43 days.

(21) Appl. No.: 10/211,981

(22) Filed: Aug. 2, 2002

(51) Int. Cl.[7] ..... A62C 2/00

(52) U.S. Cl. ..... 169/44; 169/13; 169/14; 169/24; 239/68; 239/73; 239/304

(58) Field of Search ..... 169/13, 14, 15, 169/24, 44; 239/68, 73, 69, 303, 304, 305

(56) References Cited

U.S. PATENT DOCUMENTS

| | | | | |
|---|---|---|---|---|
| 3,677,092 | A | | 7/1972 | Guarino |
| 3,786,869 | A | * | 1/1974 | McLoughlin ..... 169/24 |
| 3,883,075 | A | * | 5/1975 | Edney ..... 239/380 |
| 3,945,252 | A | * | 3/1976 | Fiore ..... 73/204.19 |
| 4,037,664 | A | | 7/1977 | Gibson |
| 4,064,891 | A | | 12/1977 | Eberhardt |
| 4,189,005 | A | | 2/1980 | McLoughlin |
| 4,259,038 | A | | 3/1981 | Jorgensen et al. |
| 4,324,294 | A | | 4/1982 | McLoughlin et al. |
| 4,417,601 | A | | 11/1983 | Bennett |
| 4,436,487 | A | | 3/1984 | Purvis et al. |
| 4,448,256 | A | | 5/1984 | Eberhardt et al. |
| 4,474,680 | A | | 10/1984 | Kroll |
| 4,526,234 | A | | 7/1985 | Little |
| 4,554,939 | A | | 11/1985 | Kern et al. |
| 4,633,895 | A | | 1/1987 | Eberhardt |
| 4,830,589 | A | | 5/1989 | Pareja |
| 4,899,825 | A | | 2/1990 | Bosoni et al. |
| 5,009,244 | A | | 4/1991 | Grindley et al. |
| 5,174,383 | A | | 12/1992 | Haugen et al. |
| 5,218,988 | A | | 6/1993 | McNamara et al. |
| 5,232,052 | A | | 8/1993 | Arvidson et al. |
| 5,271,526 | A | * | 12/1993 | Williams ..... 222/16 |
| 5,284,174 | A | | 2/1994 | Norman |
| 5,291,951 | A | | 3/1994 | Morand |
| 5,313,548 | A | | 5/1994 | Arvidson et al. |
| 5,335,734 | A | * | 8/1994 | Scott et al. ..... 169/15 |
| 5,411,100 | A | | 5/1995 | Laskaris et al. |
| 5,427,181 | A | | 6/1995 | Laskaris et al. |
| 5,494,112 | A | | 2/1996 | Arvidson et al. |
| RE35,362 | E | | 10/1996 | Arvidson et al. |
| 5,680,329 | A | | 10/1997 | Lloyd et al. |
| 5,727,933 | A | | 3/1998 | Laskaris et al. |
| 5,764,463 | A | | 6/1998 | Arvidson et al. |
| 5,765,644 | A | | 6/1998 | Arvidson et al. |

(List continued on next page.)

FOREIGN PATENT DOCUMENTS

| | | | |
|---|---|---|---|
| DE | 3038-334 | | 10/1982 |
| EP | 000040595 A2 | * | 11/1981 |

*Primary Examiner*—William E. Tapolcai
*Assistant Examiner*—Mohammad M. Ali
(74) *Attorney, Agent, or Firm*—Ryan Kromholz & Manion, S.C.

(57) ABSTRACT

A system and method of maintaining a desired additive to water ration in a fire-fighting system including a water flow sensor configured to measure the water flow rate, a water pump, a hydraulic pump, a linear hydraulic cylinder driven by the hydraulic pump, an additive pump mechanically coupled to the linear hydraulic cylinder; and a pump displacement sensor configured to sense the position of the additive pump, the pump displacement sensor being in communication with the water flow sensor to maintain a pre-determined ratio of additive to water.

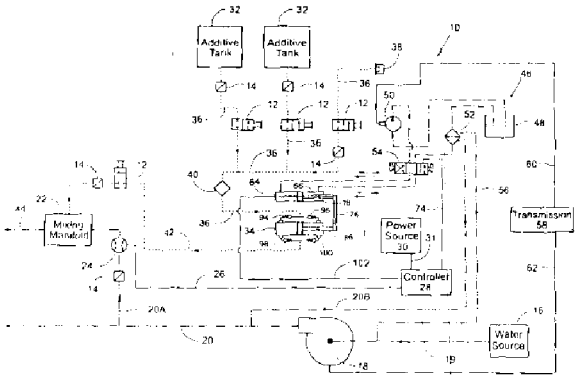

38 Claims, 5 Drawing Sheets